US010045404B2

(12) United States Patent
Ollila et al.

(10) Patent No.: US 10,045,404 B2
(45) Date of Patent: Aug. 7, 2018

(54) CLAMPING CYLINDER FOR AN ELECTRODE SLIPPING DEVICE

(71) Applicant: OUTOTEC (FINLAND) OY, Espoo (FI)

(72) Inventors: Janne Ollila, Espoo (FI); Ari Ceder, Masala (FI); Seppo Juvonen, Porvoo (FI); Tom Rönnberg, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 109 days.

(21) Appl. No.: 14/902,620

(22) PCT Filed: Jun. 25, 2014

(86) PCT No.: PCT/FI2014/050521
§ 371 (c)(1),
(2) Date: Jan. 4, 2016

(87) PCT Pub. No.: WO2015/001180
PCT Pub. Date: Jan. 8, 2015

(65) Prior Publication Data

US 2016/0205729 A1 Jul. 14, 2016

(30) Foreign Application Priority Data

Jul. 5, 2013 (FI) ..... 20135746

(51) Int. Cl.
*H05B 7/10* (2006.01)
*H05B 7/107* (2006.01)
*H05B 7/109* (2006.01)

(52) U.S. Cl.
CPC ..... *H05B 7/107* (2013.01); *H05B 7/109* (2013.01)

(58) Field of Classification Search
CPC ... H05B 7/10; H05B 7/11; H05B 7/14; H05B 7/102; H05B 7/103; H05B 7/105; H05B 7/107; H05B 7/109
(Continued)

(56) References Cited

U.S. PATENT DOCUMENTS 3,686,421 A 8/1972 Wunsche et al.
4,154,974 A 5/1979 Wynne
(Continued)

FOREIGN PATENT DOCUMENTS

DE 196 01 115 A1 7/1996
GB 262481 A 12/1927
WO WO 2010/114525 A1 10/2010

OTHER PUBLICATIONS

International Search Report (PCT/ISA/210) dated Oct. 16, 2014, by the Finnish Patent Office as the International Searching Authority for International Application No. PCT/FI2014/050521.
(Continued)

*Primary Examiner* — Hung D Nguyen
(74) *Attorney, Agent, or Firm* — Buchanan, Ingersoll & Rooney PC

(57) ABSTRACT

An electrode slipping device comprises an upper holder and a lower holder, both holders containing one or more clamping shoes and one or more clamping cylinders in co-operation with the clamping shoes. The clamping shoes are operable between a position where the electrode is clamped and a position where the electrode is unclamped. The clamping cylinder is connected to the electrode holder by first fastening means and to the clamping shoe by second fastening means such that the clamping cylinder can be released from engagement with the holder by unlocking both sets of fastening means.

3 Claims, 4 Drawing Sheets

(58) Field of Classification Search
USPC ..... 373/94, 95, 96, 98, 99, 100, 106
See application file for complete search history.

(56) References Cited

U.S. PATENT DOCUMENTS

| | | | | |
|---|---|---|---|---|
| 4,182,927 | A | 1/1980 | Phillips | |
| 4,227,030 | A * | 10/1980 | Osterwold | G01R 31/00 373/100 |
| 4,577,325 | A | 3/1986 | Mertin et al. | |
| 7,075,966 | B2 * | 7/2006 | McCaffrey | H05B 7/102 373/100 |
| 7,095,777 | B2 | 8/2006 | Sidorski | |
| 2012/0140788 | A1 | 6/2012 | Carkin et al. | |
| 2015/0173131 | A1 * | 6/2015 | Venter | F27B 3/085 373/101 |

OTHER PUBLICATIONS

PCT International Preliminary Report on Patentability (PCT/IPEA/409) dated Oct. 16, 2015, by the Japanese Patent Office as the International Searching Authority for International Application No. PCT/FI2014/050521.

Search Report issued by the Finnish Patent and Registration Office in corresponding Finnish Patent Application No. 20135746 dated Feb. 17, 2014 (1 page).

* cited by examiner

CLAMPING CYLINDER FOR AN ELECTRODE SLIPPING DEVICE

FIELD OF THE INVENTION

The invention relates to a clamping cylinder for an electrode slipping device which comprises an upper annular holder ring and a lower annular holder ring, both containing one or more clamping assemblies including a clamping shoe and a clamping cylinder arranged in co-operation so that the clamping shoe is operable between a position where the electrode is clamped and a position where the electrode is unclamped.

BACKGROUND OF THE INVENTION

The majority of electrodes used in electric arc furnaces are self-baking electrodes, so called Söderberg electrodes. A self-baking electrode consists of an electrode casing extending from the top of the electrode to below electrode contact shoes in the furnace, and an electrode portion which initially consists of a carbon based paste in the electrode casing and which is baked by electric current into an electrically conductive solid cylindrical form in the lower portion of the electrode casing. Electrical current is connected between three-phase electrode tips, and the arc formed between the electrodes will consume the baked electrode. The electrode is held by a slipping device that allows controlled displacement of the electrode.

The slipping device generally consists of two clamping rings which are sequentially operated and moved to extend the electrode as the tip of the electrode is consumed in use in the furnace. The two rings are connected with hydraulic cylinders that enable relative movement between the upper and lower clamping rings.

This action enables slipping through of the electrode casing whilst always maintaining a positive grip on the casing.

GB 262481 discloses an electrode holder in the form of a ring or frame provided with pistons by which clamping pressure is exerted on the electrode. Either the clamping or releasing movement of the pistons or both of such movements can be effected by fluid pressure. Alternatively, the clamping movement of the pistons can be affected by springs.

U.S. Pat. No. 4,154,974 A discloses a clamp assembly for suspending an arc furnace electrode, including a plurality of contact shoes adapted to bear against the surface of the electrode. The contact shoes are pivotally mounted adjacent their upper ends. Force producing means independent of the shoe support engages each contact shoe for forcing the same into high pressure engagement with the electrode.

U.S. Pat. No. 7,075,966 B2 discloses a slipping clamp assembly for holding an axially-extending electrode and for axially raising and lowering the electrode. The slipping clamp assembly comprises a first slipping sleeve for exerting a first clamping force on the electrode, a second slipping sleeve for exerting a second clamping force on the electrode, and a slipping clamp frame to which both slipping sleeves are connected. Both slipping sleeves are axially movable relative to the frame and independent on one another.

U.S. Pat. No. 7,095,777 B2 discloses an electrode slipping device arrangement including a lower electrode slip clamp surrounding the electrode and carried by a ring beam, an upper electrode slip clamp which is movable relatively to the lower clamp, slipping cylinders which are connected to and between both slipping clamps, and electrical load regulating cylinders which are connected to act between the ring beam and fixed structure above the furnace roof. The electrode column also includes at least one resiliently yieldable load resisting device which is located between the upper slip clamp and structure on the ring beam and on which the electrode, when clamped only by the upper slip clamp may totally be supported and means for measuring the load induced of the load resisting device. This slipping device arrangement allows monitoring of the length of the electrode.

In a slipping device comprising clamping shoes and clamping cylinders which are arranged to exert a normal force on the electrode, clamping cylinders need to be removed from time to time for maintenance or replacement purposes. Typically the clamping cylinder has to be dismantled in place, which is troublesome and time-consuming.

OBJECTIVE OF THE INVENTION

It is an objective of the present invention to provide a clamping cylinder which is easy to remove from its place and replace with another cylinder.

SUMMARY OF THE INVENTION

The clamping cylinder according to the present invention is characterized by what is presented in claim 1.

The new clamping cylinder can be connected to the annular holder ring by first fastening means and to the clamping shoe by second fastening means, and the clamping cylinder can be released from engagement with the annular holder ring by unlocking both fastening means. The first and second fastening means can comprise studs, screws, bolts, nuts, or a combination of them.

According to one aspect of the invention the clamping cylinder comprises a stationary cylinder element, which can be connected to the annular holder ring by first fastening means, and a movable cylinder element, which can be connected to the clamping shoe by second fastening means.

According to one aspect of the invention the movable cylinder element comprises drawers, which can be retained in contact with the clamping shoe by the second fastening means.

According to one aspect of the invention the movable cylinder element comprises a pressing piece that can be pressed against the clamping shoe to force the clamping shoe against the electrode.

According to one aspect of the invention the movements of the movable cylinder element in relation to the stationary cylinder element are effected by fluid pressure, or spring force, or both.

The new way of connecting the clamping cylinder to the annular holder ring and the clamping shoe allows easy removal of the clamping cylinder from the annular ring holders of the slipping device.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Figure 1:
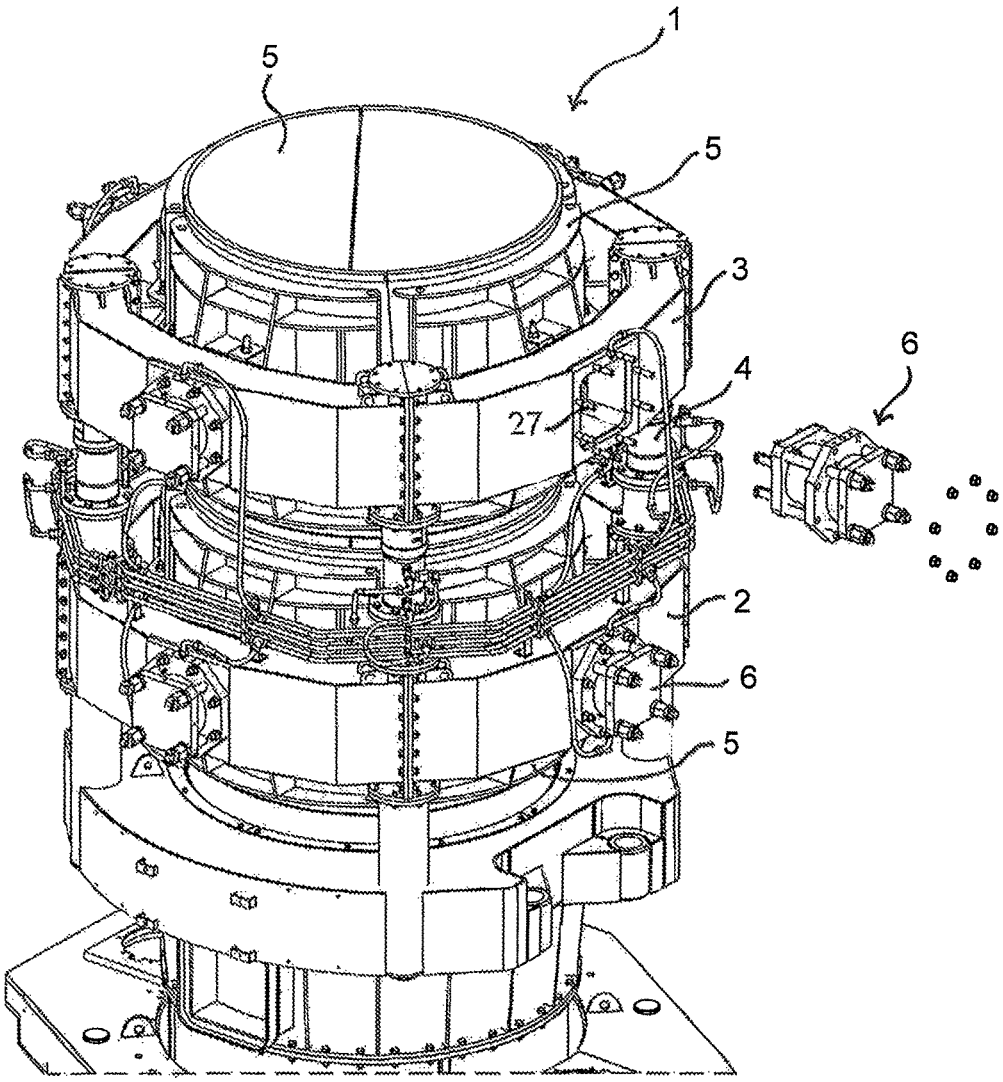
FIG. 1 is an axonometric view of a slipping device, showing one of clamping cylinders disconnected.

FIG. 1 is a schematic illustration of a slipping device 1 which can be used in connection with a self-baking electrode. The slipping device 1 comprises a lower annular holder ring 2 and an upper annular holder ring 3 which are connected with four hydraulic cylinders 4 that enable relative movement between the lower annular holder ring 2 and the upper annular holder ring 3. This movement enables slipping through of the electrode, which is surrounded by the annular holder rings 2, 3, while always maintaining a positive grip on the electrode.

Four clamping shoes 5 are provided in connection with each annular holder ring 2, 3 at uniform intervals. The clamping shoes 5 are concave friction plates which can be pressed against the electrode located within the annular holder rings 2, 3 to clamp the electrode.

Both annular holder rings 2, 3 are also provided with four spring loaded clamping cylinders 6 which can be operated to force the clamping shoes 5 into pressure contact with the electrode and to release the pressure contact between the clamping shoes 5 and the electrode. Each clamping shoe 5 forms a clamping assembly together with a clamping cylinder 6 so that the clamping shoe 5 can be forced into pressure contact with the electrode and released from pressure contact with the electrode by the action of the clamping cylinder 6.

Furthermore, the slipping device 1 also comprises hydraulic equipment needed for proper operation of the hydraulic cylinders 4 and the hydraulically operated, spring loaded clamping cylinders 6.

The operation principle of the slipping device 1 will be discussed in the following.

In the beginning, all the clamping shoes 5 of the upper annular holder ring 3 and lower annular holder ring 2 are in pressure contact with the electrode, clamping the electrode against the gravitational force.

When there is a need to lower the electrode, the clamping shoes 5 of the lower annular holder ring 2 are released from pressing against the electrode. This can be done by means of hydraulically operated, spring loaded clamping cylinders 6. The electrode is now suspended only by the clamping shoes 5 of the upper annular holder ring 3. The lower annular holder ring 2 is lowered in relation to the upper annular holder ring 3 by means of the hydraulic cylinders 4. After that, the clamping shoes 5 of the lower annular holder ring 2 are pressed against the electrode by means of the spring loaded clamping cylinders 6 of the lower annular holder ring 2.

Thereafter the same procedure is repeated with the clamping shoes 5 of the upper annular holder ring 3.

Finally, the electrode is again held in place with the help of the clamping shoes 5 of both annular holder rings 2, 3, until a new need arises to lower the electrode again.

Figure 3:
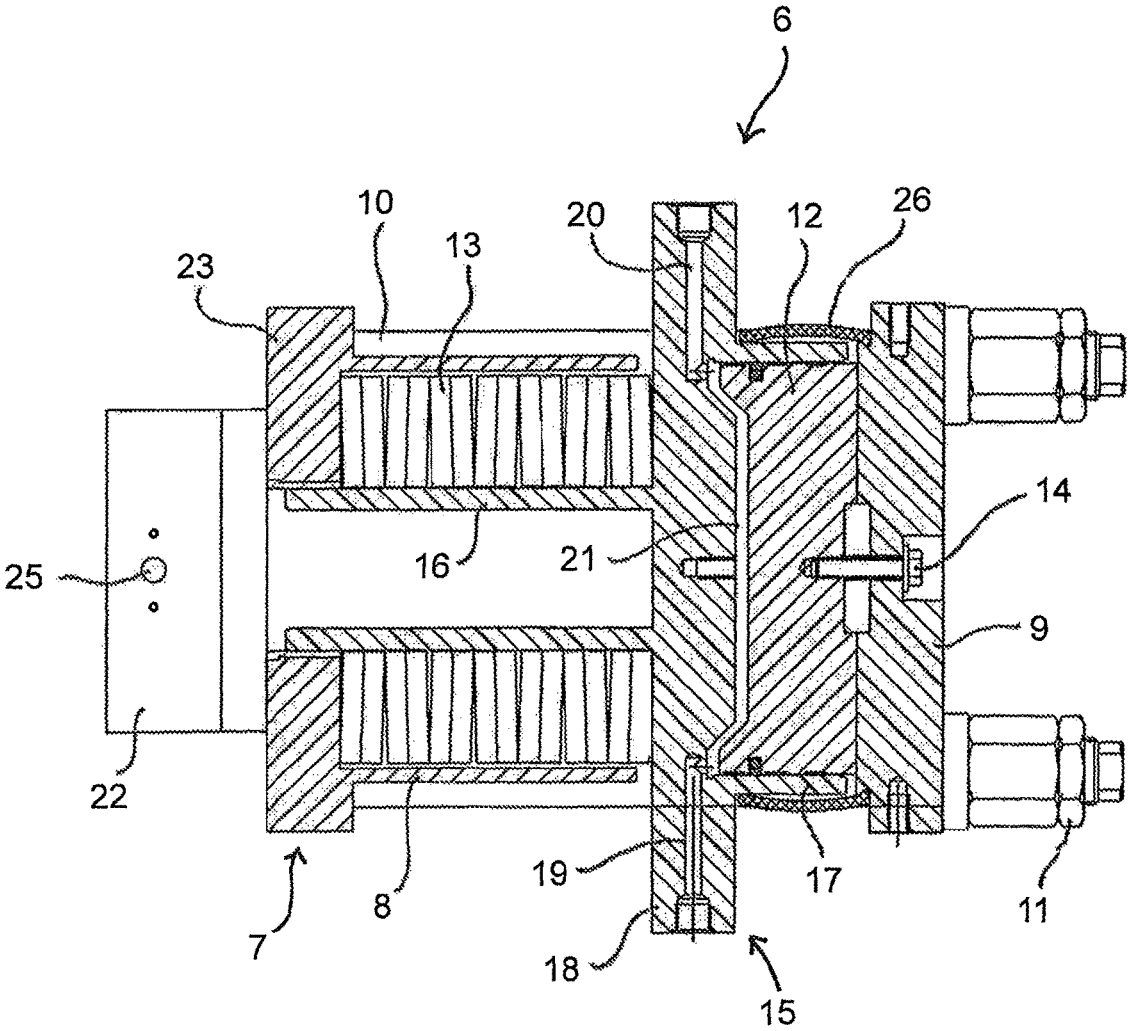
FIG. 3 is a sectional side view of the clamping cylinder.
Figure 4:
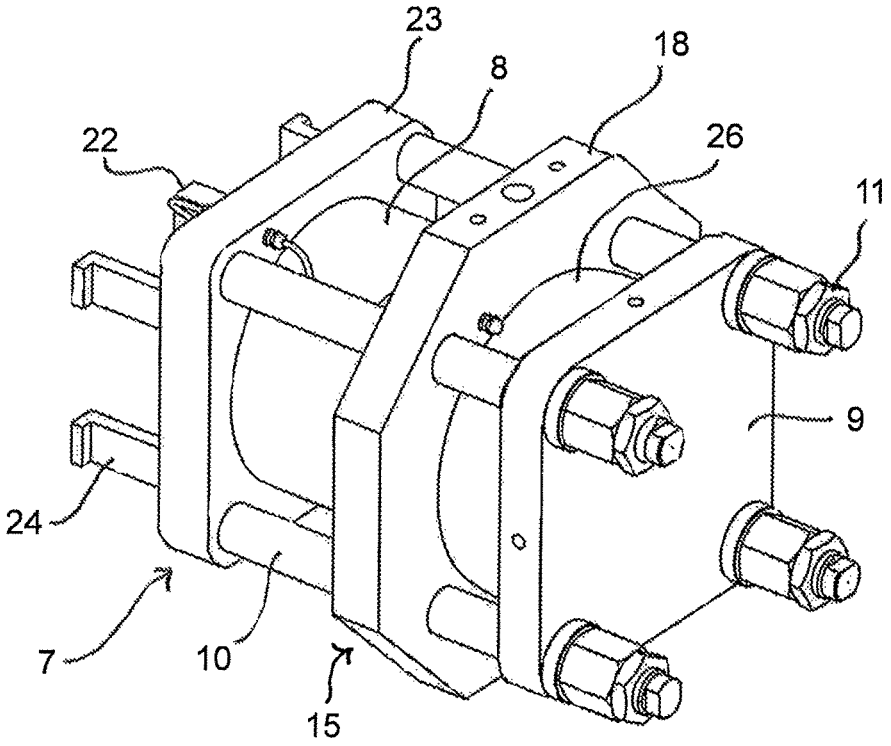
FIG. 4 is an axonometric front view of the clamping cylinder.
Figure 5:
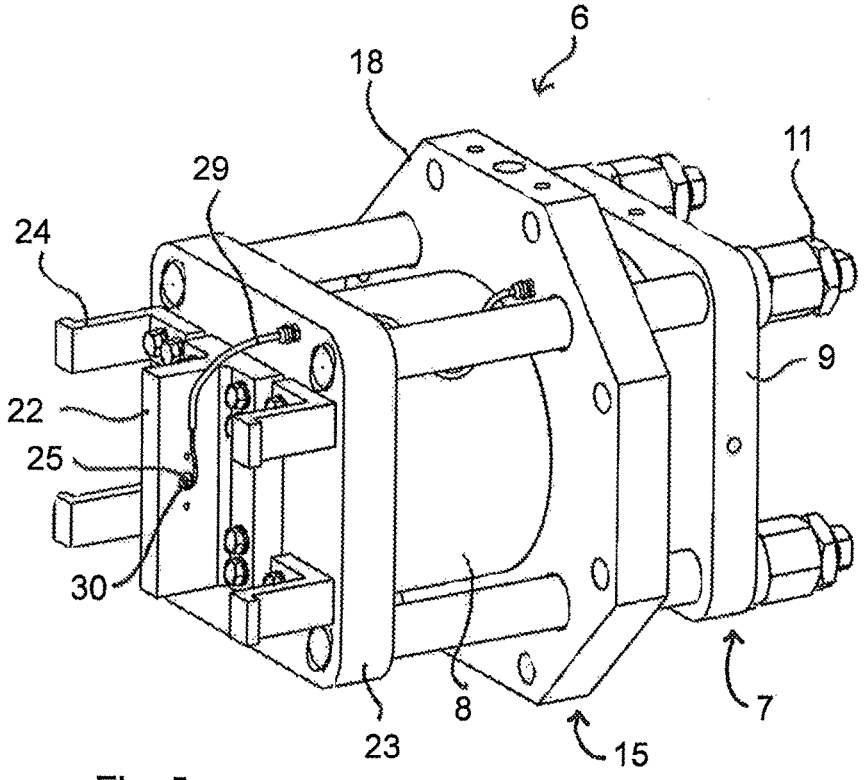
FIG. 5 is an axonometric back view of the clamping cylinder.

The structure of a spring loaded clamping cylinder 6 is illustrated in more detail in FIGS. 3-5.

The clamping cylinder 6 comprises a spring cylinder housing 8, which is connected to a spring cylinder head 9 by means of four spring cylinder drawbars 10 and locking nuts 11 fixed at the outer ends of the drawbars 10. A spring cylinder piston 12 is fastened to the inner surface of the spring cylinder head 9 by means of a fastening screw 14. A disk spring 13 is located in the spring cylinder housing 8. The spring cylinder housing 8, spring cylinder head 9 and spring cylinder drawbars 10 together form a movable cylinder element 7.

A stationary cylinder element 15 is arranged on the spring cylinder drawbars 10 between the spring cylinder housing 8 and the spring cylinder head 9. The stationary cylinder element 15 comprises a first cylinder portion 16 enveloping the disk spring 13 from inward, a second cylinder portion 17 enveloping the spring cylinder piston 12 from outward, and a flange portion 18 connecting the first cylinder portion 16 to the second cylinder portion 17. The flange portion 18 is provided with a first fluid passage 19 and a second fluid passage 20, which are connectable to the hydraulic system, and a fluid chamber 21 confined between the spring cylinder piston 12 and the flange portion 18. The annular gap between the spring cylinder head 9 and the flange portion 18 is covered and sealed by a piston protection sealing 26.

Figure 2:
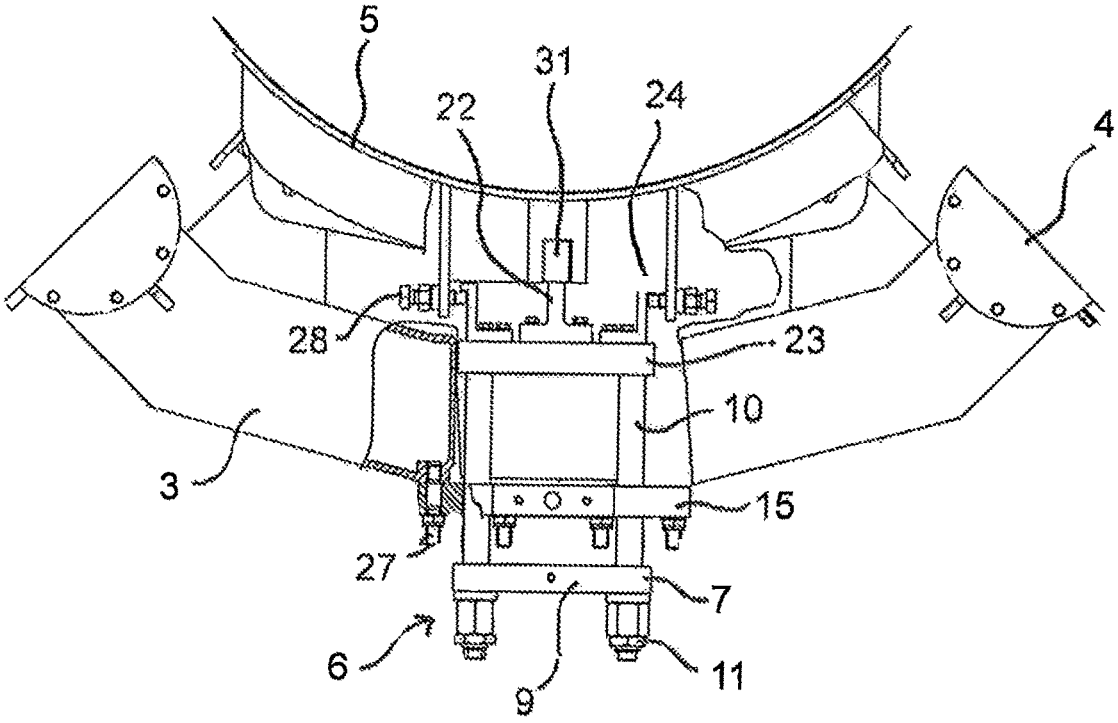
FIG. 2 is a partial and partly sectional top view of a clamping cylinder mounted in the slipping device.

The stationary cylinder element 15 can be secured to the annular holder ring 3 by means of bolts 27 (FIG. 2). The spring cylinder housing 8, the spring cylinder head 9 and the spring cylinder drawbars 10 make up a movable element 7 that can slide a small distance closer to the electrode (to the left in FIG. 3) and farther off from the electrode (to the right in FIG. 3).

A spring cylinder pressing piece 22 is fastened into an end plate 23 of the spring cylinder housing 8. In a clamping situation, the pressing piece 22 exerts a clamping force to a force receiving part 31 in the clamping shoe 5 (FIG. 2). Also four drawers 24 for drawing the clamping shoe 5 apart from the electrode are fastened into the end plate 23. The drawers 24 are provided with L-shaped locking ends which enable anchoring the spring cylinder housing 8 to the clamping shoe 5 with locking screws 28 (FIG. 2). The coupling between the drawers 24 and the clamping shoe 5 can be dismantled by removing the locking screws 28.

The operation principle of the clamping cylinder 6 will be discussed in the following.

Normally the spring force of the disk spring 13 keeps the spring cylinder pressing piece 22 pressed against the clamping shoe 5 so that the clamping shoe 5 is clamped against the electrode. Four clamping cylinders 6 are arranged symmetrically around the electrode casing and the clamping forces created by each clamping cylinder 6 should be equal.

To release the clamping pressure, the fluid chamber 21 between the flange portion 18 and the spring cylinder piston 12 is filled with hydraulic fluid, which forces the movable element 7 to slide to the right against the force of the disk spring 13. As the spring cylinder housing 8 is connected to the clamping shoe 5, the movement of the spring cylinder piston 12 to the right reduces the pressure that is exerted to the electrode by the clamping shoe 5. As the similar procedure is carried out in connection with each clamping cylinder 6 of the same annular holder ring 2 or 3, the pressure contact between the electrode and the clamping shoes 5 is released. This allows displacement of the annular holder ring 2 or 3 so that the electrode can be lowered or raised a small distance.

The steps of removing a clamping cylinder 6 from an annular holder ring 2, 3 will be discussed in the following.

First, all the clamping cylinders 6 of the same holder ring 2, 3 are pressurized with hydraulic fluid so that the pressure in the fluid chamber 21 urges the movable cylinder element 7 to a position most distant from the clamping shoe 5. In this position, the pressure exerted by the spring cylinder pressing piece 22 to the force receiving part 31 in the clamping shoe 5 is at its lowest.

Then, locking screws 28 locking the drawers 24 of the movable cylinder element 7 to the clamping shoe 5 are released.

Then, bolts 27 locking the flange portion 18 of the stationary cylinder element 15 to the annular holder ring 2, 3 are released.

Finally, the hydraulic system is disconnected and the hydraulic hoses are disengaged from the clamping cylinder 6, after which the clamping cylinder 6 can be removed from the annular holder ring 3 as illustrated in FIG. 1.

The number of clamping assemblies in an annular holder ring 2, 3 can be different from four.

Instead of the locking screws 28, any other suitable fastening means can be used for detachably connecting the movable cylinder element 7 to the clamping shoe 5.

Instead of the bolts 27, any other suitable fastening means can be used for detachably connecting the stationary cylinder element 15 to the annular holder ring 2, 3.

Although the above example teaches pressurizing the clamping shoe 5 by spring force and releasing the pressure by hydraulic force, it could also be possible to pressurize by hydraulic force and depressurize by spring force. Instead of hydraulic force, also pneumatic force could be used.

Above the invention has been described by way of examples with reference to the exemplifying embodiments and implementations illustrated in the accompanying drawings. The invention is, however, not confined to the exemplifying embodiments shown in the drawings alone but it rather covers various modifications and equivalent arrangements, which fall within the scope of the following claims.

The invention claimed is:

1. A clamping cylinder for an electrode slipping device which comprises an upper annular holder ring and a lower annular holder ring, both containing one or more clamping assemblies including a clamping shoe and the clamping cylinder arranged in co-operation so that the clamping shoe is operable between a clamping position and a releasing position wherein the clamping cylinder is connectable to the annular holder ring by first fastening means and to the clamping shoe by second fastening means, and that the clamping cylinder can be released from engagement with the annular holder ring by unlocking both fastening means, wherein the clamping cylinder comprises a stationary cylinder element, which is connectable to the annular holder ring by first fastening means, and a movable cylinder element, which is connectable to the clamping shoe by second fastening means, and wherein drawers which are retained in contact with the clamping shoe by the second fastening means and a pressing piece that is pressed against the clamping shoe to force the clamping shoe against the electrode are mounted to an end wall of the movable cylinder element.

2. The clamping cylinder of claim 1, wherein the first and second fastening means comprise studs, screws, bolts, nuts, or a combination of them.

3. The clamping cylinder of claim 1, wherein the movements of the movable cylinder element in relation to the stationary cylinder element are effected by fluid pressure, or spring force, or both.

* * * * *